US009923300B2

(12) United States Patent
Marrs et al.

(10) Patent No.: US 9,923,300 B2
(45) Date of Patent: Mar. 20, 2018

(54) SEMI-RIGID HIGH-VOLTAGE EXTENDER

(71) Applicant: MARSHALL ELECTRIC CORP., Rochester, IN (US)

(72) Inventors: Thomas C. Marrs, Rochester, IN (US); Donald Recupido, Argos, IN (US)

(73) Assignee: MARSHALL ELECTRIC CORP., Rochester, IN (US)

( * ) Notice: Subject to any disclaimer, the term of this patent is extended or adjusted under 35 U.S.C. 154(b) by 0 days.

(21) Appl. No.: 15/157,925

(22) Filed: May 18, 2016

(65) Prior Publication Data

US 2017/0338589 A1 Nov. 23, 2017

(51) Int. Cl.

| | |
|---|---|
| ***H01R 13/44*** | (2006.01) |
| ***H01R 13/53*** | (2006.01) |
| ***H01R 33/02*** | (2006.01) |
| ***H01R 33/965*** | (2006.01) |
| ***H01R 13/631*** | (2006.01) |

(52) U.S. Cl.
CPC ..... *H01R 13/53* (2013.01); *H01R 13/631* (2013.01); *H01R 33/02* (2013.01); *H01R 33/965* (2013.01)

(58) Field of Classification Search
CPC ..... H01R 13/53
USPC ..... 439/125; 313/136, 143
See application file for complete search history.

(56) References Cited

U.S. PATENT DOCUMENTS 3,076,113 A * 1/1963 Candelise ..... H01R 13/5219 174/77 S
4,514,712 A * 4/1985 McDougal ..... H01F 38/12 123/169 PA
4,944,259 A 7/1990 Richardson
5,060,624 A * 10/1991 Bruning ..... F02F 1/242 123/169 PA
5,357,233 A * 10/1994 Wada ..... H01F 38/12 123/634
5,577,921 A * 11/1996 Philyaw ..... H01T 13/04 123/169 PA
5,685,282 A * 11/1997 Murata ..... H01T 13/04 123/169 PA
5,716,223 A * 2/1998 Phillips, Jr. ..... H01T 13/06 439/125
5,749,742 A * 5/1998 Bertuzzi, Jr. ..... H01R 13/6276 439/125
6,068,495 A 5/2000 Virchow
6,340,303 B2 1/2002 Hamada et al.
6,467,447 B1 * 10/2002 Holmes ..... F02P 13/00 123/169 PA (Continued)

*Primary Examiner* — Tulsidas C Patel
*Assistant Examiner* — Peter G Leigh
(74) *Attorney, Agent, or Firm* — Egbert Law Offices, PLLC

(57) ABSTRACT

An extender for connecting a high-voltage source to a spark plug has a conductive member, a tube having an interior passageway in which the conductive member is positioned therein, and a boot affixed over an exterior of the tube. The boot is formed of a material having a rigidity less than a rigidity of a material of the tube. The boot has a first end adapted to connect with the high-voltage source and a second end adapted to be connected to the spark plug such that the conductive member is in electrical connection with the spark plug and the high-voltage source. The conductive member includes a spring that is adapted to electrically connect with the high-voltage source and the spark plug.

17 Claims, 6 Drawing Sheets

(56) References Cited

U.S. PATENT DOCUMENTS

| | | | | |
|---|---|---|---|---|
| 6,570,304 | B1 * | 5/2003 | Okazaki | G01L 23/22 313/118 |
| 6,817,872 | B1 * | 11/2004 | Berg | H01R 13/533 439/11 |
| 6,932,627 | B2 * | 8/2005 | Raff | H01T 13/04 439/125 |
| 7,594,489 | B1 * | 9/2009 | Marrs | H01T 13/04 123/143 C |
| 7,768,183 | B2 * | 8/2010 | Callahan | H01T 13/08 313/137 |
| 7,825,573 | B2 * | 11/2010 | Callahan | H01T 13/06 313/135 |
| 8,164,241 | B2 * | 4/2012 | Miller | H01T 13/04 313/136 |
| 8,388,359 | B1 * | 3/2013 | Mahoney | H01R 13/2464 439/125 |
| 8,474,428 | B2 * | 7/2013 | Lykowski | H01T 13/04 123/143 B |
| 8,995,046 | B2 * | 3/2015 | Mori | G02F 1/167 204/450 |
| 2012/0322280 | A1 * | 12/2012 | Fuma | H01T 13/06 439/125 |
| 2013/0293332 | A1 * | 11/2013 | Skinner | H01F 27/02 336/90 |
| 2014/0154901 | A1 * | 6/2014 | Schulze | H01R 24/38 439/125 |
| 2016/0248187 | A1 * | 8/2016 | Szyszko | H01R 13/506 |

* cited by examiner

SEMI-RIGID HIGH-VOLTAGE EXTENDER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to high-voltage extenders for connecting a high-voltage source to a spark plug. More particularly, the present invention relates to extenders that are semi-rigid and which insulate a conductive member that is connected to an ignition coil at one end and a spark plug at an opposite end.

2. Description of Related Art Including Information Disclosed Under 37 CFR 1.97 and 37 CFR 1.98.

Extenders are often used for the connection of high voltage sources, such as ignition coils, to spark plugs. These high voltage extenders are intended to pass the charge from the high voltage source (having a maximum voltage of 43 KV) to the ignition coils. Typically, these extenders are suitably insulated so as to prevent tracking from the conductive rod to the electrical ground created by the engine block.

FIG. 1 illustrates one example of a prior art high voltage extender utilized and sold by Caterpillar, Inc. The high voltage extender 10 has a machined stainless steel rod 12 that has a threaded end 14 and a connecting end 16. The threaded end 14 is machined onto the stainless steel rod 12 so as to connect into the female thread of the high voltage connector of an ignition coil. The connection end 16 connects to the high voltage terminal of a spark plug. A spring 18 is affixed to the connection end 16 of the stainless steel rod 12. The connection is accomplished by compressing the voluted spring 18 against the high voltage terminal of the spark plug. The spring 18 is received within a stainless steel cup 20 which is attached to the stainless steel rod 12. The rod 12 is pressed into a machined sleeve 22 of "void free" polytetrafluoroethylene, otherwise known as TEFLON. (TM). The sleeve 22 serves to insulate the stainless steel rod 12 from the electrical ground created by the ignition block.

As can be seen in FIG. 1, the sleeve 22 has a narrow diameter portion 24 overlying the threaded end 14 of the stainless steel rod 12. A main section 26 of the sleeve 22 extends along the rod 12 from the narrow diameter portion 24. The main section 26 has a greater diameter than the diameter of the narrow diameter portion 24. The sleeve 22 defines a receptacle 28 at an end opposite the narrow diameter portion 24. Receptacle 28 is suitable for receiving a portion of a spark plug therein. An O-ring seal 30 is received within a notch 32 formed in the interior wall of receptacle 28 at the end of the sleeve 22. The sleeve 22 has a constant diameter extending from the narrow diameter portion 24.

Experiments with the prior art of FIG. 1 have determined that during extended periods of high-voltage (30-40 kV), the voltage punctures the polytetrafluoroethylene sleeve at a point where the stainless steel cup 20 is nearest the high voltage terminal of the spark plug. This occurs in an average of 5 to 10 hours when a grounded metal sleeve is placed over the extender 10. During thermal cycling, the polytetrafluoroethylene expands and contracts lengthwise and creates a gap at the inner face surface of the extender 10 and the insulating surface of the high voltage connection of the ignition coil. This allow tracking along the surface to the electrical ground created by the engine block. During shipping, the extender 10 has a tendency to loosen. This also serves to create a gap at the area of the interface of the ignition coil and the extender 10. The polytetrafluoroethylene material "cold flows." This allows the extender 10 to loosen.

Engines that burn natural gas are becoming extremely popular. Natural gas produces low emissions are very economically. Unfortunately, when spark plugs are used to ignite natural gas, they will have a very high temperature (of up to 250° C.). As such, the prior art high-voltage extenders would deteriorate rapidly over time when subjected to such temperatures. As such, a need has developed whereby the high-voltage extender can withstand the high temperatures of such bar plugs of natural gas engines.

In the past, various U.S. patents have issued relating to such high voltage extenders. For example, U.S. Pat. No. 4,944,259, issued on Jul. 31,1990 to R. D. Richardson, teaches an ignition system with an insulated and extendable extender. This extender resiliently biases the extender between the source of high energy and the spark plug to provide a positive and reliable electrical connection therebetween. The extender is of a relatively rigid construction so as to prevent bending. The extender is combined with a shield in the engine to further protect and increase the functional life of the components.

U.S. Pat. No. 5,060,624, issued on Oct. 29, 1991 to Bruning et al., provides an engine ignition system that has a transformer assembly and positioning means. The transformer assembly has an elongated body having a cup portion containing the coils, a base portion, and a stem portion. A conducting core extends through the stem and base portions. A suitable clip connects the core electrically to a spark plug installed in a profiled bore of the cylinder head. A positioning device is provided to positively align and contain the transformer assembly within a valve mechanism compartment defined between the cover and the cylinder head. A spring member connected to the cup portion. Depending guide members formed within the cover cooperate with each other.

U.S. Pat. No. 5,357,233, issued on Oct. 18, 1994 to Z. Wada, teaches an extension device which extends from the ignition coil to supply the peak high-voltage output to a spark plug. A part of an outer periphery of the secondary coil at an intermediate position of the outer periphery of the secondary coil sinks in relation to the other part of the outer periphery of the secondary coil to form a groove extending in a radial direction of the secondary coil. The peak high-voltage output is transmitted from the secondary coil through the groove to the extension device. The extension device includes a first member extending from the ignition coil, a second member for being connected to the spark plug, and an elastic member connecting the first member to the second member so that the first member moves elastically in relation to the second member.

U.S. Pat. No. 5,577,921, issued on Nov. 26, 1996 to Philyaw et al., discloses an electrical connector system for electrically connecting a voltage source to a spark plug terminal. This transformer assembly has an elongate body including a cup portion containing primary and secondary coils, a base portion, and a stem that is adapted to be installed in a housing of a cylinder head. An electrical source extends through the stem and base portion. An electrical connecting system includes an electrical conductor adapted to receive the voltage source with a spring contacting the end of a spark plug terminal biasing the conductor in a direction away from the spark plug. The electrical connector system further includes a positioning device adapted to positively align and contain the transformer assembly within a valve mechanism compartment defined between a cover and the cylinder head. A spring member is connected to the cup portion so as to axially bias the electrical conductor in a direction toward the spring in contact with the spark plug terminal so as to ensure an electrical connection.

U.S. Pat. No. 5,685,282 issued on Nov. 11, 1997 to Murata et al., discloses an ignition device for an internal combustion engine. This ignition device has a spark plug including a high voltage terminal, an ignition coil for generating a high voltage, and adapter assembly for electrically connecting the ignition coil to the high voltage terminal of the spark plug. The adapter assembly has a support sleeve for accommodating and supporting the high voltage terminal of the spark plug against a transverse movement of the high voltage terminal. The support sleeve is either a continuous extension or a metal tube of the adapter assembly. The assembly may also include a wear-resistant material.

U.S. Pat. No. 6,068,495, issued on May 30, 2000 to F. Virchow, discloses a spark plug for an internal combustion engine. A connector sleeve is formed of an insulating material. An elastic member is connected to the connector sleeve so as to seal the gap between the connector sleeve and a spark plug well. A ceramic inlet is formed in the connector sleeve so as to enclose the plug-in contact and the ignition cable connection.

U.S. Pat. No. 6,340,303, issued on Jan. 22, 2002 to Hamada et al., describes a high tension connection for the spark plug of an internal combustion engine. This connection portion has a first high tension connection terminal, a second high tension connection terminal for electrically connecting with the first high tension connection terminal, a locking mechanism provided between the first high tension connection terminal and the second high tension connection terminal for restricting the separation therebetween in the axial direction, and a spring member disposed between the first high tension connection terminal and the second high tension connection terminal. This device serves to prevent an instantaneous breakdown of the connection if an external force is applied to the high tension portion.

U.S. Pat. No. 6,817,872, issued on Nov. 16, 2004 to S. M. Berg, describes a heat-protective spark plug extension. The extender includes an elongated body formed of heat resistant and electrically insulative material that extends between a spark plug engagement end and a spark plug wire connector end. A conductor is located within the body and includes a fitting adapted to releasably electrically connect to a spark plug wire. A receptacle is adapted for electrical connection to a spark plug. An adjustment part permits adjustable movement of the spark plug wire connector end relative to the conductive receptacle.

U.S. Pat. No. 7,594,489, issued on Sep. 29, 2009 to the present Applicant, describes a high-voltage extender for connecting a high-voltage source to a spark plug. The extender has a conductive rod with one end suitable for electrical connection to the high-voltage source and a second end suitable for electrical connection to the spark plug. A sleeve is injection-molded over the conductive rod so as to be in void-free relation with an exterior surface of the conductive rod. The conductive rod has a first end extending outwardly therefrom. The sleeve defines a spark plug-receiving receptacle at the second end of the conductive rod. An O-ring is received in a notch formed adjacent to the first end of the conductive rod. Another O-ring is received in a notch formed around the inner wall of the receptacle. A spring is affixed to the second end of the conductive rod.

It is an object of the present invention to provide an extender that provides semi-rigidity in the connection between a high-voltage source and a spark plug.

It is another object of the present invention to provide an extender that allows for slight angular misalignment between the high-voltage source and the spark plug.

It is another object of the present invention to provide an extender that does not compromise the dielectric integrity at the seal with the spark plug.

It is another object of the present invention to provide an extender that prevents high-voltage tracking.

It is another object of the present invention to provide an extender that can withstand voltage that is in excess of 36 kV.

It is still further object of the present invention to provide a high-voltage extender that avoids radial deflection of the spring/conductive connection with the spark plug.

It is a further object of the present invention provide an extender which is resistant to the corona created in the engine block.

It is still a further object of the present invention to provide an extender that is easy to manufacture, easy to install and use, and relatively inexpensive.

It is still another object of the present invention to provide an extender that can withstand high temperature conditions, such as those produced by natural gas engines.

These and other objects and advantages of the present invention will become apparent from a reading of the attached specification and appended claims.

BRIEF SUMMARY OF THE INVENTION

The present invention is an extender for connecting a high-voltage source to a spark plug. The extender comprises a conductive member, a tube having an interior passageway in which the conductive member has at least a portion positioned in the interior passageway, and a boot affixed over an exterior of the tube. The boot is formed of an material having a rigidity less than a rigidity of the material of the tube. The boot has a first end adapted to connect with a high-voltage source and a second end adapted to be connected to the spark plug such that the conductive member is in electrical connection with the spark plug and the high-voltage source.

In the present invention, the conductive member comprises a spring. The spring is adapted to electrically connect with the high-voltage source and the spark plug. The spring extends longitudinally through an interior of the boot. The tube overlies a portion of the spring.

In an embodiment of the present invention, the boot has a first portion and a second portion that is affixed to an end of the first portion. The first portion is adapted to connect with a high-voltage source. The second portion is adapted to connect with the spark plug. The first portion has a rigidity that is less than a rigidity of the second portion. The first portion is formed of a silicone rubber material. The second portion is formed of a polyethylene terephthalate material (PET) or a liquid crystal polymer material.

The first portion has at least one annular notch formed in an inner wall thereof adjacent to an end of the first portion opposite the end adapted for connection to the high-voltage source. The second portion has an insert element fitted within the first portion. The second portion has a protrusion on the insert element that is received in the annular notch.

The tube has a flange formed adjacent one end thereof The boot has an internal shoulder formed adjacent the end that is adapted for connection to the high-voltage source. The flange abuts the interior shoulder of the boot. An O-ring is affixed within the boot adjacent the end adapted for connection to the spark plug. The O-ring is adapted to engage a terminal of the spark plug.

The foregoing Section is intended to describe, with particularity, the preferred embodiments of the present invention. It is understood that modifications to these preferred embodiments can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
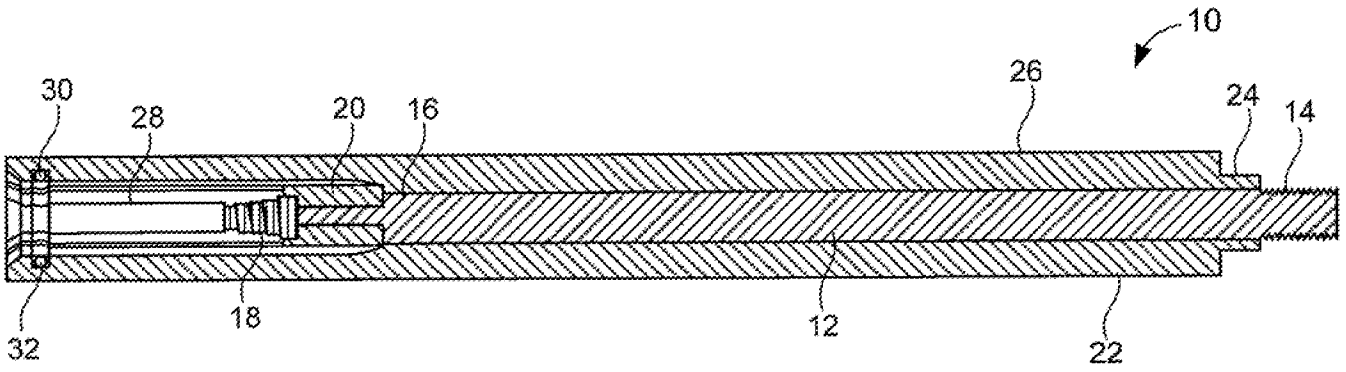
FIG. 1 Prior Art
FIG. 1 is a cross-sectional view of a prior art extender.
Figure 2:
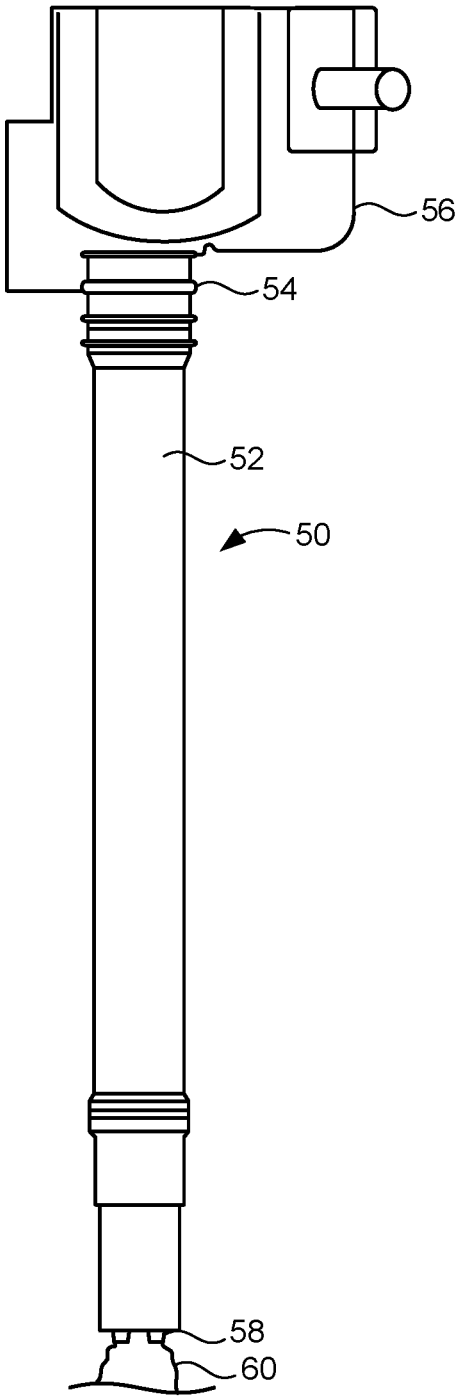
FIG. 2 is a side elevational view showing the extender of the present invention as secured to a high-voltage source

Referring to FIG. 2, there shown the high-voltage extender 50 in accordance with a first embodiment of the present invention. The high-voltage extender 50 is a longitudinal member that has a boot 52 extending over the exterior surface of a conductive member. In particular, the boot 52 has a connector 54 at one end thereof. Connector 54 is illustrated as connected to a high-voltage source 56, such as an ignition coil. The boot 52 has an opposite end 58 that is adapted to connect with a terminal 60 of a spark plug. The high-voltage extender 50 is intended to transmit electrical energy from the high-voltage source 56 to the terminal 60 of the spark plug.

Figure 3:
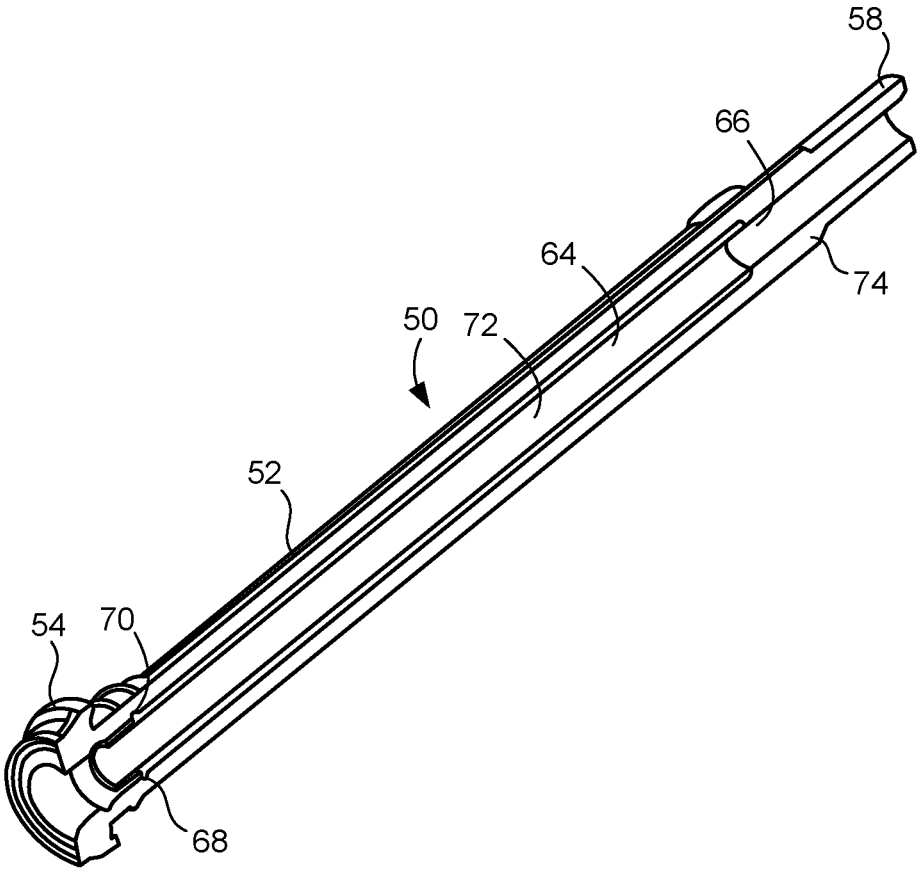
FIG. 3 is a cross-sectional view, in perspective, of the extender in accordance with a first embodiment of the present invention.

FIG. 3 illustrates a cross-sectional view of the first embodiment of the extender 50 of the present invention with the conductive member omitted. In particular, it can be seen that the extender 50 has the boot 52 extending longitudinally with a connector 54 at one end and a connector 58 at an opposite end thereof. In particular, as will be described hereinafter, an O-ring can be affixed within the end 58 so as to securely connect the boot 52 to the spark plug terminal 60 so that an electrical connection can be established between the high-voltage source 56 and the spark plug.

In FIG. 3, it can be seen that there is a tube 64 that is affixed within the interior of the boot 52. The tube 64 can be inserted into the interior passageway 66 of the boot 52 or the boot 52 can be over-molded onto the tube 64 such that there are no voids between the exterior of tube 64 and the interior of boot 52. As can be seen, the tube 64 extends for a portion of the length of the interior 66 of the boot 52. The tube 64 includes a protrusion 68 adjacent to the connector 54 which is received within an annular notch 70 formed in the inner wall of the boot 52. The tube 64 also has an interior passageway 72 into which the conductive member is received.

Importantly, in the present invention, the tube 64 will have a rigidity that is greater than the rigidity of the boot 52. In particular, the boot 52 can be formed of an MS115 silicone rubber material. The tube 64 can be formed of a PET RE5329 material or a liquid crystal polymer material. As such, the tube 64 will provide rigidity to the silicone rubber material of the boot 52 for a substantial portion of the length of the boot 52. However, the outwardly extending end portion 74 of the boot 52 can be semi-flexible so as to compensate for slight angular misalignment between the high-voltage source 56 and the terminal 60 of the spark plug. The rigidity of the tube 64 will serve to protect the conductive member so as to avoid radial deflection of the conductive member.

Figure 4:
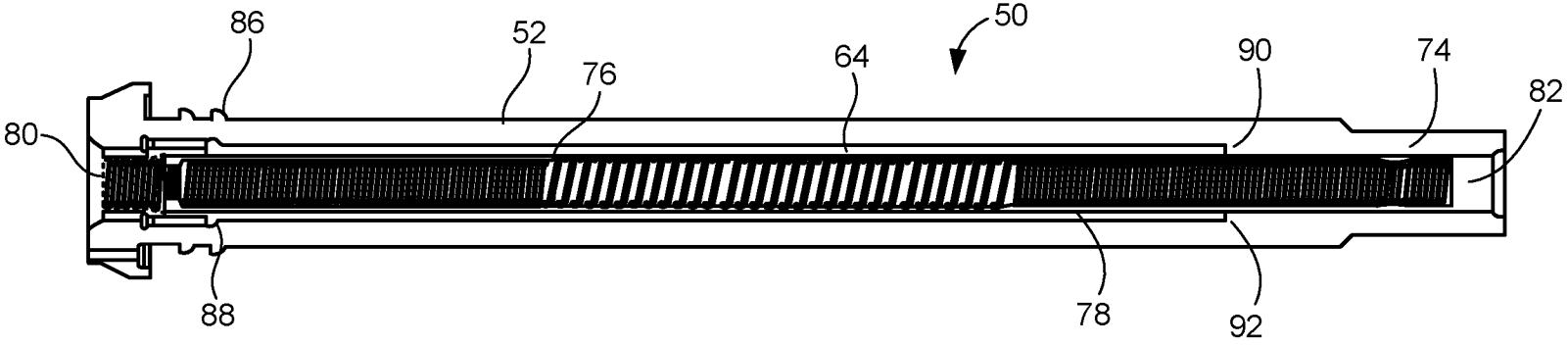
FIG. 4 is a cross-sectional view of the extender of the first embodiment of the present invention.

FIG. 4 is a cross-sectional view of the extender 50. In FIG. 4, the conductive member 76 is illustrated as received within the tube 64 and within the interior of the boot 52. The conductive member 76 includes a spring 78 that extends from an end 80 to an end 82. End 80 is suitable for connection to a terminal of the high-voltage source 56. The end 82 is suitable for contacting the terminal 60 of the spark plug. The spring 78 is tightly positioned within the interior passageway of the tube 64 such that the tube 64 prevents radial deflection of the spring 78. However, the flexible end portion 74 of the boot 52 can suitably deflect, along with the spring contained therein. Once again, the interior diameter of the boot 52 in the area adjacent to the spring 78 near end 82 will be very close so as to further avoid radial deflection of the spring 78. Whenever the end 80 contacts the terminal of the high-voltage source 56 and the end 82 connects with the terminal 60 of the spark plug, an electrically conductive connection is achieved between the high-voltage source 56 and the spark plug. The spring 78 is preferably formed of Stainless Steel 304 material.

In FIG. 4, it can be seen that the inner wall of the boot 52 has an internal shoulder 86. The end of the tube 64 includes an annular flange 88. Annular flange 88 abuts the internal shoulder 86 so as to secure the position of the tube 64 within the boot 52. There is also another internal shoulder 90 formed on the inner wall of the boot 52. The end 92 of the tube 64 is securely abutted against the internal shoulder 90. Once again, this further serves to fix the position of the tube 64 within the boot 52.

As can be seen in FIG. 4, the polymeric tube 64 provides the necessary rigidity to the extender 50 during installation on to the spark plug. The semi-rigid nature of the extender 50 also allows for slight angular misalignment to the spark plug without compromising the dielectric integrity of the sealing at the spark plug. The special overlapping connection is designed prevent high-voltage tracking and withstand voltages in excess of 36 kV. An O-ring can be affixed within the end of the boot 52 so as to further seal around the terminal 60 of the spark plug. The spring 78 is contained internal of the tube 64 so as to offer dielectric strength and a means for minimizing the radial deflection of the spring.

Figure 5:
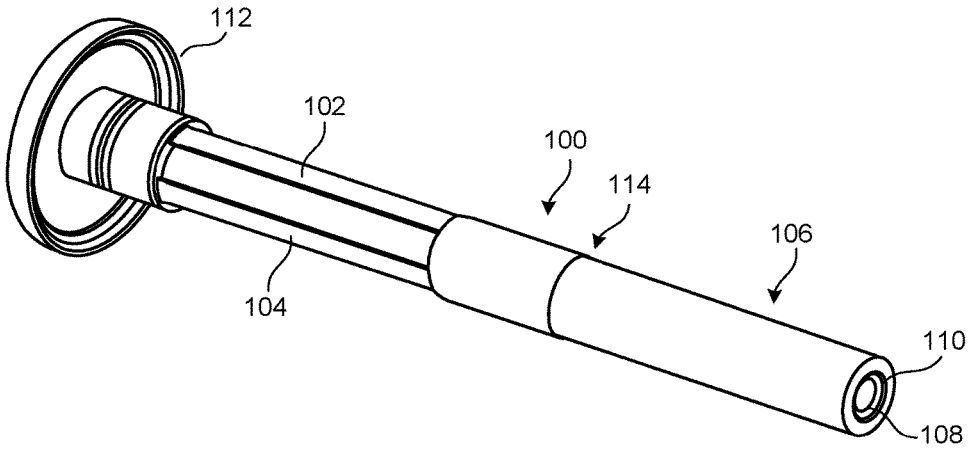
FIG. 5 is a perspective view showing the extender in accordance with a second embodiment of the present invention.

FIG. 5 shows an alternative embodiment of the extender 100 in accordance with the teachings of the present invention. The extender 100 is illustrated as having the boot 102 having a first portion 104 and a second portion 106. The first portion 104 can be formed of an MS115 silicone rubber material. The second portion 106 can be formed of polytetrafluoroethylene (TEFLON) (™), PET or liquid crystal polymer material. As such, the second portion 106 will have a rigidity that is slightly greater than the rigidity of the first portion 104. A silicone rubber O-ring seal 108 is illustrated as positioned within the end 110 of the second portion 106. The first portion 104 has a connector 112 that is adapted to connect with the high-voltage source. The second portion 106 has an insert element (not shown) which is received within the end 114 of the first portion 104 of the boot 102.

Figure 6:
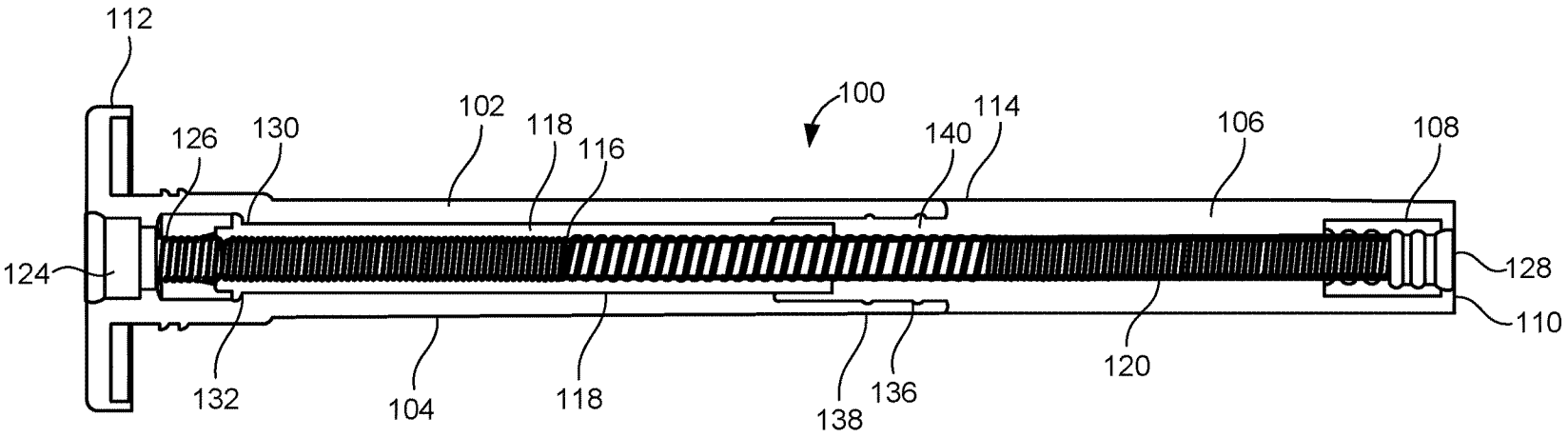
FIG. 6 is a cross-sectional view of the extender of the second embodiment of the present invention.

FIG. 6 illustrates the internal configuration of the extender 100 of the alternative embodiment of the present invention. In particular, in FIG. 6, it can be seen that there is a conductive member 116 that is positioned within the interior of a tube 118. The conductive member 116 has a spring 120 arranged similar to that of the first embodiment.

The terminal 124 of the high-voltage source is illustrated as received within the connector 112 at one end of the extender 100. The terminal 124 will abut an end 126 of the spring 120. A terminal 128 of a spark plug is received within the O-ring seal 108 located at end 110 of the second portion 106 of the boot 102. The spring 120 has an opposite end that will abut the end of the terminal 128. The spring 120 extends longitudinally through the interior of the boot 102 and through the interior of the tube 118. As such, the spring 120 serves to provide an electrical connection between the terminal 124 of the high-voltage source and with the terminal 128 of the spark plug.

The first portion 104 of the boot 102 has an internal shoulder 130 formed adjacent to the connector 112. An annular flange 132 is formed at the end of the tube 118 so as to securely abut with the internal shoulder 130. The second portion 106 of the boot 102 includes an insert element 136 that is received within the end 114 of the first portion 104 of boot 102. In particular, there is a shoulder formed on the second portion 106 which will abut the end 114 of the first portion 104. An annular notch 138 is formed on an inner wall of the first portion 104 of boot 102. A protrusion 140 formed on the exterior of the insert element 136 of the second portion 106 can be secured within this annular notch 138. Within the concept of the present invention, a plurality of annular notches 138 can be formed in spaced planar parallel relationship to each other. Similarly, a plurality of protrusions 140 can also be provided on the exterior surface of the insert element 136 of the second portion 106 so as to further establish a secure connection between the portions 104 and 106 of boot 102.

In FIG. 6, it can be seen that the inner wall of the second portion 106 is in a tight fitting relation with the exterior surface of the spring 120. Similarly, the inner wall of the tube 118 is in tight fitting relationship with the exterior of the spring 120. As such, the serves to resist any radial deflection of the spring.

The surface between the high-voltage connection of the ignition coil and the extender utilizes O-ring seals on the extender 100 so as to seal the interface and to prevent high-voltage leakage. Because the tube is injection molded as an insert on the boot, the tube cannot move within the boot rotationally or lengthwise. This keeps the surface of the extender at the ignition coil and further prevents high-voltage leakage at this point. The materials used in the extender of the present invention are more resistant to the corona created in the engine block. During testing, the extender of the present invention achieved a longer period of use without failure compared to the extender of the prior art.

Experiments conducted with the high-voltage extender of the present invention, all embodiments, is able to withstand temperatures of up to 200° C. As such, the high-voltage extender is particularly useful in association with natural gas engines.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

We claim:

1. An extender for connecting a high-voltage source to a high-voltage terminal of a spark plug, the extender comprising:

a spring being conductive and adapted to connect at one end with the high voltage source and at another end to the spark plug;

a tube having an interior passageway, said spring having at least a portion positioned in said interior passageway of said tube; and a boot affixed over an exterior of said tube, said boot being formed of a material having a rigidity less than a rigidity of a material of said tube, said boot having a first end adapted to connect with the high-voltage source and a second end adapted to be connected to the spark plug such that said spring is in direct electrical connection with the spark plug and the high-voltage source, said tube having an end positioned inwardly of said second end of said boot so as to be spaced longitudinally away from the high-voltage terminal of the spark plug.

2. The extender of claim 1, wherein said spring extends longitudinally through an interior of said boot, said tube overlying a portion of said spring.

3. The extender of claim 1, wherein said boot has a first portion and a second portion that is affixed to an end of said first portion, said first portion adapted to connect with the high-voltage source, said second portion adapted to connect to the spark plug.

4. The extender of claim 3, wherein said first portion has a rigidity that is less than a rigidity of said second portion.

5. The extender claim 4, wherein said first portion is formed of a silicone rubber material, said second portion being formed of a material selected from the group consisting of polyethylene terephthate, liquid crystal polymer and a polytetrafluoroethylene.

6. The extender claim 3, wherein said first portion has at least one annular notch formed in an inner wall thereof adjacent an end of said first portion opposite the end adapted for connection to the high-voltage source, said second portion having an insert element fitted within said first portion, said second portion having a protrusion received in the annular notch.

7. The extender of claim 1, wherein said tube has a flange formed adjacent one end thereof, said boot having an internal shoulder formed adjacent to the end adapted for connection to the high-voltage source, said flange abutting said interior shoulder.

8. The extender of claim 1, further comprising:

an O-ring affixed within said boot adjacent to the end adapted for connection to the spark plug, said O-ring adapted to engage a terminal of the spark plug.

9. An ignition system comprising:

a high-voltage source;

a spark plug having a high-voltage terminal;

a conductive spring having one end directly electrically connected to said high-voltage source and an opposite end directly electrically connected to said spark plug;

a tube having an interior passageway, said conductive spring having at least a portion positioned in said interior passageway of said tube, said tube having an end positioned longitudinally away from the high-voltage terminal of said spark plug; and a boot affixed over an exterior of said tube, said boot having a first end connected to said high-voltage source and an opposite end connected to said spark plug, said end of said tube being longitudinally inwardly of said opposite end of said boot.

10. The ignition system of claim 9, wherein said tube is formed of a material having a rigidity greater than a rigidity of a material of said boot.

11. The ignition system of claim 9, wherein said spring extends longitudinally through an interior of said boot, said tube overlying at least a portion of said conductive spring.

12. The ignition system of claim 9, wherein said boot has a first portion and a second portion that is affixed to an end of said first portion, said first portion connected to the high-voltage source, said second portion connected to said spark plug.

13. The ignition system of claim 12, wherein said first portion has a rigidity that is less than a rigidity of said second portion.

14. The ignition system of claim 12, wherein said first portion has at least one annular notch formed in an inner wall thereof adjacent an end of said first portion opposite the end connected to said high-voltage source, said second portion having an insert element fitted within said first portion, said second portion having a protrusion on said insert element that is received in the annular notch.

15. The ignition system of claim 9, further comprising:

an O-ring affixed within said boot adjacent the end of said boot connected to said spark plug, said O-ring engaging a terminal of said spark plug.

16. An extender for connecting a high-voltage source to a high-voltage terminal of spark plug, the extender comprising:

a spring that is conductive and adapted to connect directly with the high-voltage source and the high-voltage terminal of the spark plug;

a tube having an interior passageway, said conductive member having at least a portion positioned in said interior passageway of said tube; and a boot affixed over an exterior of said tube, said boot having a first end adapted to connect with the high-voltage source and a second end adapted be connected to the spark plug such that said spring is in direct electrical connection with the high-voltage terminal spark plug and the high-voltage source, said boot having a first portion and a second portion that is affixed to an end of said first portion, said first portion adapted to connect with the high-voltage source, said second portion adapted to connect to the spark plug, said first portion having a rigidity less than a rigidity of said second portion, said tube having an end positioned longitudinally inwardly of an end of said second portion of said boot opposite said first portion of said boot so as to be spaced longitudinally away from the high-voltage terminal of the spark plug.

17. The extender of claim 16, wherein said boot is formed of a material having a rigidity less than a rigidity of a material of said tube.

* * * * *